US005855694A

United States Patent [19]

Toge et al.

[11] Patent Number: 5,855,694

[45] Date of Patent: Jan. 5, 1999

[54] METHOD FOR PRODUCING GRAIN-ORIENTED SILICON STEEL SHEET

[75] Inventors: Tetsuo Toge; Atsuhito Honda; Mineo Muraki; Kenichi Sadahiro; Minoru Takashima, all of Okayama, Japan

[73] Assignee: Kawasaki Steel Corporation, Japan

[21] Appl. No.: 907,306

[22] Filed: Aug. 6, 1997

[30] Foreign Application Priority Data

Aug. 8, 1996 [JP] Japan ..... 8-209679

[51] Int. Cl.[6] ..... H01F 1/04

[52] U.S. Cl. ..... 148/111; 148/120

[58] Field of Search ..... 148/111, 112, 148/113, 120, 121, 122

[56] References Cited

U.S. PATENT DOCUMENTS

| | | | |
|---|---|---|---|
| 3,556,873 | 1/1971 | Malagari et al. . | |
| 4,948,433 | 8/1990 | Nakashima et al. | 148/111 |
| 4,992,114 | 2/1991 | Nakashima et al. | 148/111 |
| 5,066,343 | 11/1991 | Nakashima et al. | 148/111 |
| 5,472,521 | 12/1995 | Yoshitomi et al. | 148/111 |
| 5,597,424 | 1/1997 | Yoshitomi et al. | 148/111 |

FOREIGN PATENT DOCUMENTS

| | | |
|---|---|---|
| 0 219 611 A | 4/1987 | European Pat. Off. . |
| 08 143964 A | 6/1996 | European Pat. Off. . |
| 23 51 141 A | 4/1974 | Germany . |
| 33 34 519 A1 | 3/1984 | Germany . |
| 57 207 114 A | 12/1982 | Japan . |
| 62 070521 A | 4/1987 | Japan . |

*Primary Examiner*—John Sheehan
*Attorney, Agent, or Firm*—Austin R. Miller

[57] ABSTRACT

Production of grain-oriented silicon steel sheet, in which the heating temperature of slabs is as low as that in common steels and good magnetic properties are maintained, without applying a nitriding process. The contents of Al, Se and S substantially satisfy formulae (1) and (2), and both or either of formulae (3) and (4):

$$[\text{Al (wt \%)}]+(5/9)\{[\text{Se (wt \%)}]+2.47[\text{S(wt \%)}]\}\leqq 0.027 \quad (1)$$

$$[\text{Se (wt \%)}]+2.47[\text{S (wt \%)}]\leqq 0.025 \quad (2)$$

$$0.016\leqq[\text{Al (wt \%)}]+(5/9)\{[\text{Se (wt \%)}]+2.47\,[\text{S (wt \%)}]\} \quad (3)$$

$$0.010\leqq[\text{Al (wt \%)}] \quad (4)$$

Annealing of the hot rolling sheet is applied at a temperature of about 800° C. or more, and about 1000° C. or below; preferably, cold rolling is applied at about 100° C. or more, using a tandem mill.

8 Claims, 7 Drawing Sheets

METHOD FOR PRODUCING GRAIN-ORIENTED SILICON STEEL SHEET

BACKGROUND OF THE INVENTION

1. Field of the Invention

This invention relates to a method for producing a grain-oriented silicon steel sheet, especially producing a general purpose grain-oriented silicon steel sheet having good magnetic properties with a high production performance and few cracks, if any.

2. Description of the Related Art

Grain-oriented silicon steel sheets are mainly used for iron core materials in electrical components such as transformers. It is important that they have a high magnetic flux density and low iron loss. Therefore, complex production steps are used. Hot rolling is applied to a silicon steel slab having a thickness of 100 to 300 mm, after heating the slab at a higher temperature than that applied to common steel, once or more steps of cold rolling with intermediate annealing to adjust to the final thickness of the sheet, and applying decarbonization annealing followed by finish annealing after coating the sheet with an annealing separator for the purpose of obtaining secondary recrystallized grains and purification.

It is important, for improving magnetic properties, to allow crystal grains to grow along the {110}<001> direction (Goss orientation), i.e. to align the <001> axis— an axis of easy magnetization—along the rolling axis in the secondary recrystallized grains during finish annealing. The complex process as described above is especially adapted to produce a steel sheet having a microstructure of secondary recrystallized grains highly aligned with Goss orientation.

For the purpose of enhancing growth of secondary recrystallized grains, it is important to apply a dispersion phase called an inhibitor that suppresses the growth of the primary recrystallized grains along directions other than the Goss orientation. The inhibitor is applied to the steel in a uniform and appropriate size. The inhibitor has limited solubility in steels and includes sulfides, selenides and nitrides, representative examples being MnS, MnSe and AlN.

For finely dispersing these important inhibitors such as sulfides, selenides and nitrides in appropriate sizes, a conventional method has been used in which inhibitors are allowed to precipitate during hot rolling after completely dissolving the inhibitors by heating the slab prior to hot rolling. The slab heating temperature for sufficiently forming a solid solution of inhibitors is about 1400° C., which is about 200° C. higher than that for heating common steel slabs. While heating the slabs at such a high temperature is essential for this purpose, it causes undesirable results as follows:

(1) The energy cost per unit weight of slabs is high because the slab is heated to a high temperature.

(2) Molten scale tends to be generated, and hanging of slabs is often encountered.

(3) The surfaces of the slabs are over-decarbonized.

While an induction heater for the exclusive use of crude grain oriented silicon steels was developed and used for heating the slab to solve problems (2) and (3) described above, another problem still remained: increase of energy consumption.

Energy should be saved as much as possible for producing grain-oriented silicon steel sheet in high performance. Accordingly, reduction of energy consumption for heating slabs is an urgent problem. Apart from the high grade grain-oriented silicon steel sheets, reduction of production cost is especially important in common products having medium grades of magnetic properties. Therefore, reducing the energy required in heating the slab (i.e., lowering the heating temperature) is very advantageous.

Many investigators have endeavored to lower the heating temperature of the slab in producing grain-oriented silicon steel sheets. Among many results that have been disclosed, Japanese Examined Patent Publication 54-24685 discloses reducing the temperature of heating slabs to 1050° to 1350° C. by allowing elements such as As, Bi, Pb and Sb that segregate in grain boundaries to remain in the steel, to utilize them as inhibitors. Japanese Unexamined Patent Publication No. 57-158322 discloses slabs heated at a lower temperature by reducing the content of Mn in the steel to adjust the Mn/S ratio to 2.5 or less, as well as stabilizing secondary recrystallized grains by adding Cu. In Japanese Unexamined Patent Publication No. 57-89433, the temperature for heating slabs is reduced to as low as 1000° to 1250° C. by controlling both the ratio of columnar crystals in the slab and the reduction in secondary cold rolling using a slab containing such elements as S, Se, Sb, Bi, Pb, Sn and B besides Mn.

These processes were developed under the impression that AlN having an extremely low solubility in the steel might not be used as an inhibitor. In those processes the magnetic properties were not always satisfactory because of poor suppressing ability as an inhibitor. Further, in many cases, the process can only be practiced on a laboratory scale.

Although Japanese Unexamined Patent Publication No. 59-190324 discloses pulse annealing applied for annealing the primary recrystallized grains, this art applies only to work in laboratories.

Japanese Unexamined Patent Publication 59-56522 discloses a method in which the temperature for heating slabs is decreased by adjusting the contents of Mn to 0.08 to 0.45% and of S to 0.007% or less and, in Japanese Unexamined Patent Publication 59-190325, Cr is added to the above composition for attempting to stabilize the secondary recrystallized grains. Both references are characterized by attempting to form a solid solution of MnS during heating of the slab by decreasing the percentage of S. In the case of slabs having a large mass, there arose a problem that magnetic properties along the transverse and longitudinal directions were not uniformly distributed.

A combined art of extremely low carbonization in silicon steels (C: 0.002 to 0.010%) and heating slabs at low temperature is disclosed in Japanese Unexamined Patent Publication 57-207114. This art is based on the belief that hot rolling when the temperature for heating the slab is low is advantageous for the subsequent formation of secondary recrystallized grains because the slabs do not undergo the austenite phase during coagulation. While such extremely low content of C is advantageous for preventing cracks from appearing during cold rolling, nitriding is required during decarbonization annealing for the purpose of stabilizing secondary recrystallized grains.

Once the art according to Japanese Unexamined Patent Publication 57-207114 described above has been disclosed, developments of nitriding during the production process increased. For example, an art enabling the operator to lower the temperature for heating the slab is disclosed in Japanese Unexamined Patent Publication 62-70521, wherein the conditions for finish annealing are specified and nitriding is carried out on the way of finish annealing. Further, in Japanese Unexamined Patent Publication 62-40315, a method is disclosed in which inhibitors are controlled at a proper level by a nitriding on the way of processing after adding a prescribed amount of Al and N unable to form a solid solution in the slab during heating.

However, such nitriding creates a new problem that additional facilities are required, hence increasing the cost; further, controlling nitriding on the way of finish annealing is difficult to control.

OBJECTS OF THE INVENTION

An important object is to create a method of manufacturing a grain-oriented silicon steel sheet with a slab heating temperature that is as low as that of common steels, while maintaining good magnetic properties.

Another object is to create such a process which is constant and advantageous and performed without applying nitriding on the way of annealing after cold rolling.

When the slab heating temperature is lowered, however, occurrence of cracks becomes so frequent that the yield is decreased. Accordingly, another object is to prevent fracture during cold rolling when the slab heating temperature is lowered.

Another object is to overcome the foregoing disadvantages advantageously in producing common grain-oriented silicon steel sheets with attainment of reduced production costs.

SUMMARY OF THE INVENTION

The present invention provides a method for producing a grain-oriented silicon steel sheet comprising the steps of applying hot rolling after heating a silicon steel slab, annealing the hot rolled sheet, followed by single or multiple cold rolling steps to achieve the final thickness of the sheet (with intervening annealing of multiple steps where applicable), and applying decarbonization annealing followed by finish annealing after coating the sheet with an annealing separator, wherein the approximate contents of Al, Se and S ([Al], [Se] and [S], each in wt %) satisfy both of the following formulae (1) and (2) as well as satisfying both or either of the following formulae (3) and (4):

$$[\text{Al (wt \%)}]+(5/9)\{[\text{Se (wt \%)}]+2.47[\text{S(wt \%)}]\}\leqq 0.027 \quad (1)$$

$$[\text{Se (wt \%)}]+2.47[\text{S (wt \%)}]\leqq 0.025 \quad (2)$$

$$0.016\leqq[\text{Al (wt \%)}]+(5/9)\{[\text{Se (wt \%)}]+2.47[\text{S (wt \%)}]\} \quad (3)$$

$$0.010\leqq[\text{Al (wt \%)}] \quad (4)$$

heating this slab at about 1260° C. or less and annealing the hot rolled sheet at about 800° C. or more and about 1000° C. or less.

The present invention further provides a method for producing a grain-oriented silicon steel sheet, wherein the approximate content of Al ([Al] in wt %) satisfies the following formula (5) for reducing the frequency of occurrence of cracks:

$$[\text{Al (wt \%)}]\leqq 0.020 \quad (5)$$

The grain-oriented silicon steel sheet can be continuously produced by a method in which the slab contains about 0.015 to 0.070 wt % of C and about 2.5 to 4.5 wt % of Si, and by a method in which the cold rolling is carried out at a temperature of about 100° C. or more using a tandem mill.

DESCRIPTION OF PREFERRED EMBODIMENT

Reducing the content of inhibitors has been attempted in the prior art so that AlN, MnS and MnSe can be dissolved to form a solid solution while heating the slab, for the purpose of lowering the heating temperature of the grain-oriented silicon steel sheet. Nitriding halfway of the production process was essential, however, when the contents of MnSe and MnS were reduced. We have investigated, based on the idea that deterioration of magnetic properties might be prevented by changing the conditions for annealing the hot rolled sheet, even when the contents of AlN, MnS and MnSe as inhibitors were reduced to some degree.

Figure 1:
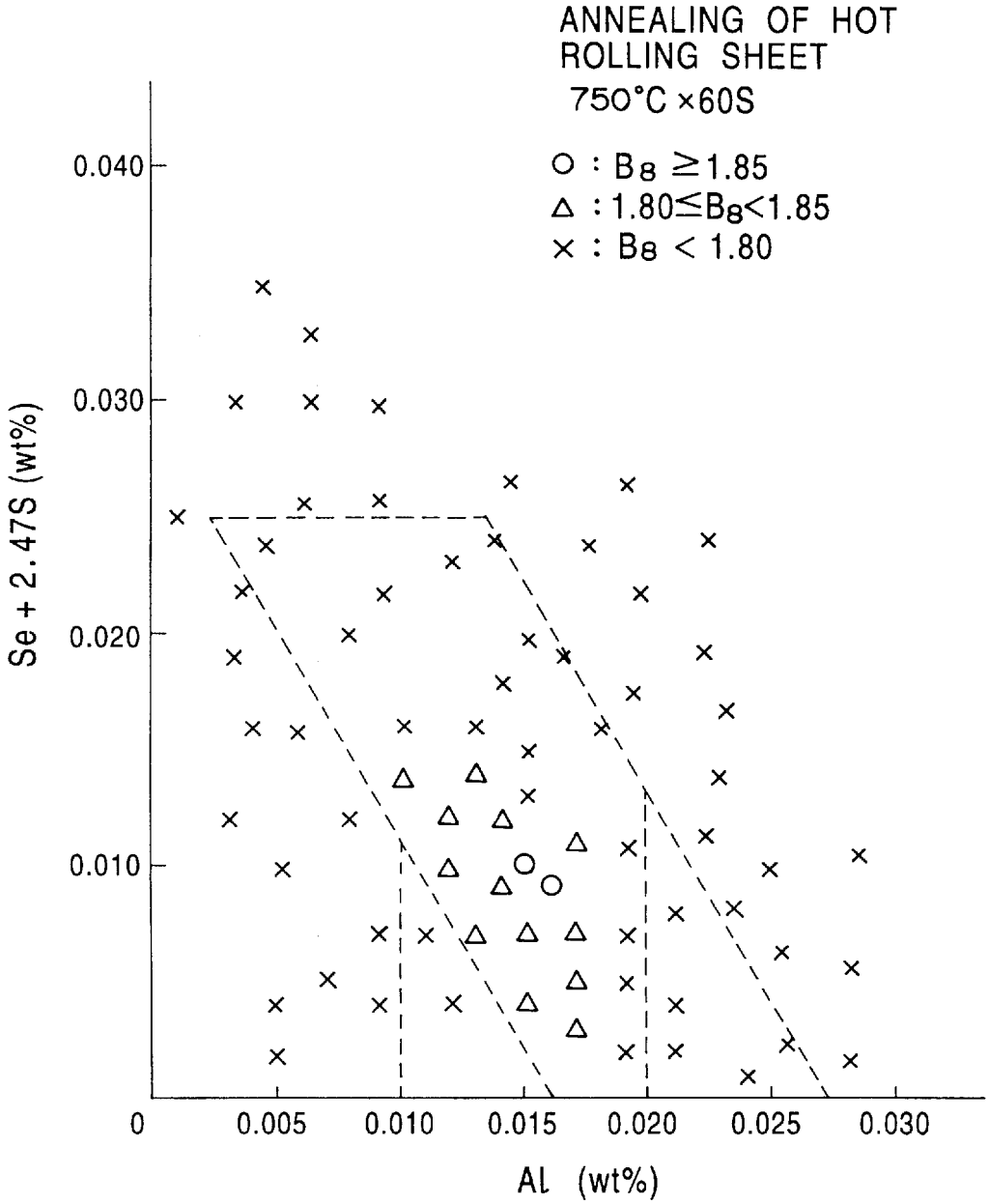
FIG. 1 is a graph showing a relationship between the contents of Al, Se and S, and magnetic properties.
Figure 2:
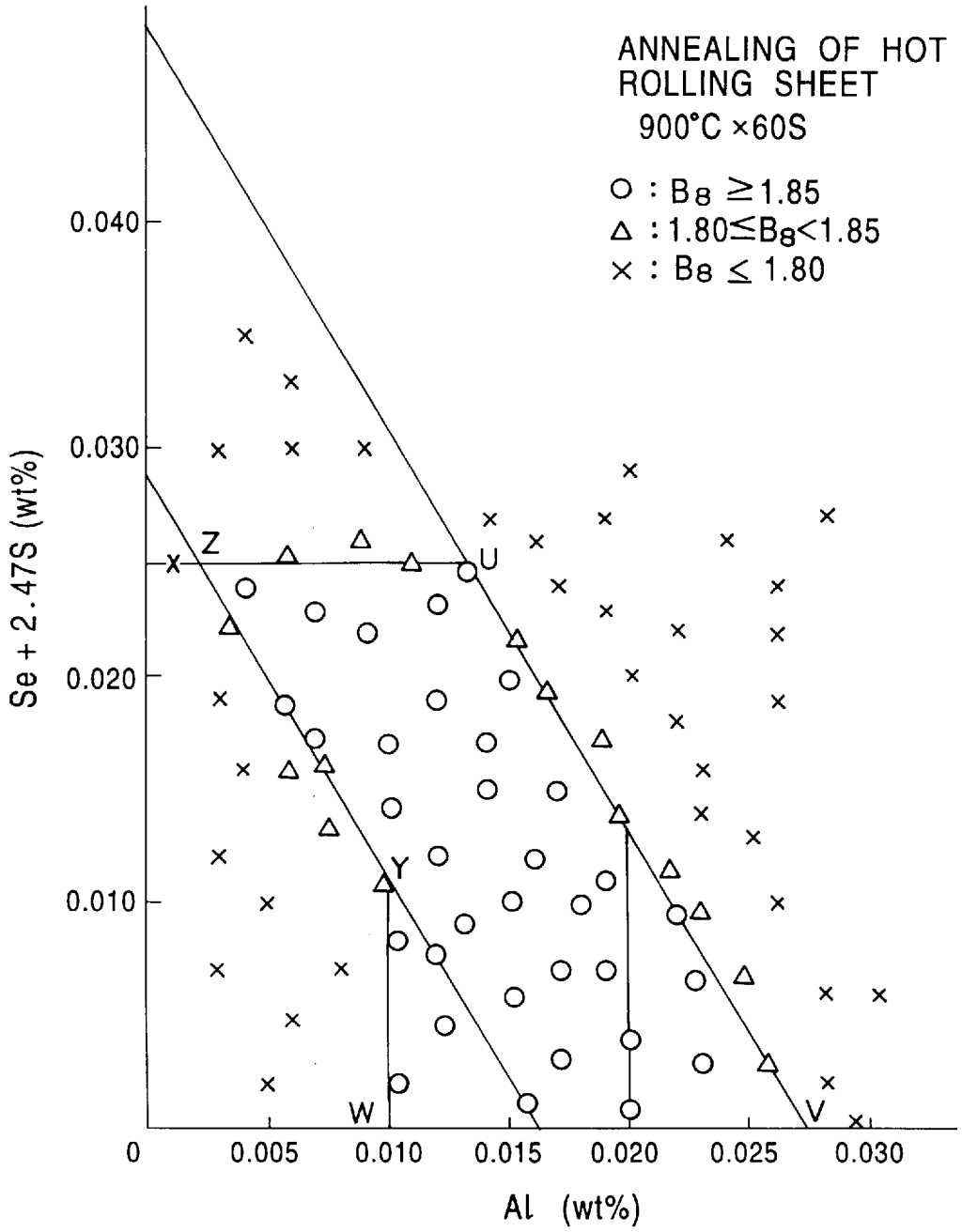
FIG. 2 is a graph showing a relationship between the contents of Al, Se and S, and magnetic properties.
Figure 3:
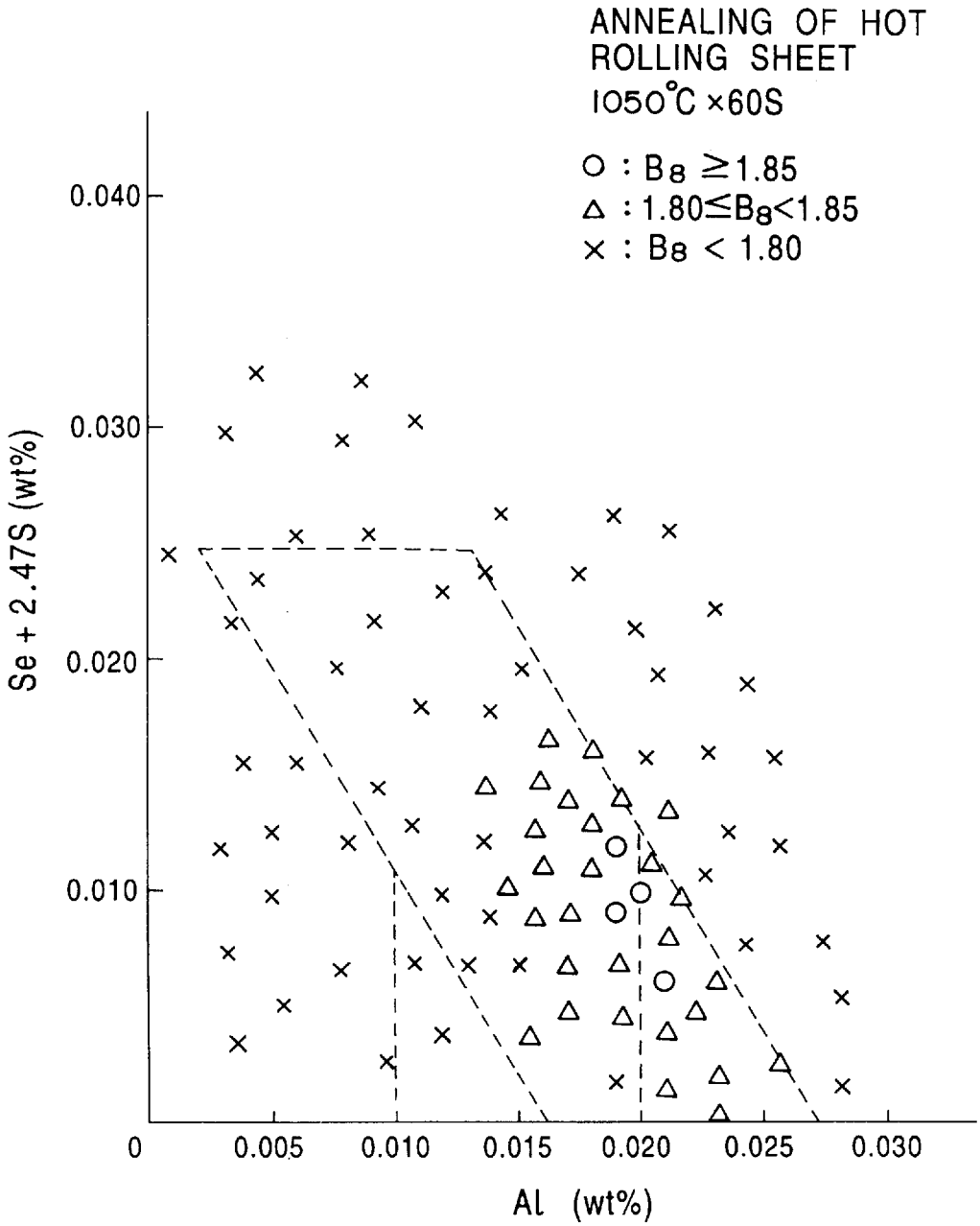
FIG. 3 is a graph showing a relationship between the contents of Al, Se and S, and magnetic properties.

Using AlN, MnSe and MnS mainly as inhibitors, we changed the content of inhibitor components in the silicon steel slab. In addition, we simultaneously controlled the contents of sulfide and selenide inhibitors (mainly MnS and MnSe) and nitrate inhibitors (mainly AlN), although the contents of both type of inhibitors had been independently controlled. After heating slabs with a thickness of 200 to 260 mm at a temperature of 1200° C., which corresponds to that for heating common steels, each slab was hot-rolled up to a thickness of 2.3 mm followed by annealing the hot rolled sheet by changing the annealing conditions to (a) 750° C.×1 min., (b) 900° C.×1 min. and (c) 1050° C.×1 min. Then, the sheet was cold rolled to a thickness of 0.35 mm followed by decarbonization annealing, coating with an annealing separator and finish annealing. The magnetic flux densities of the steel sheets obtained were measured, and the results obtained are shown in FIGS. 1, 2 and 3. These figures are the results of measurements corresponding to the annealing conditions of the hot-rolled sheets of (a) 750° C.×1 min., (b) 900° C.×1 min. and (c) 1050° C.×1 min., respectively.

The horizontal axis in each figure represents the content of Al in the slab while the vertical axis represents the sum of Se and S contents taking into account the atomic weight differences of Se and S (Se/S=2.47) that belong to the same 6B element group. We have now discovered that a special range is important from the viewpoint described above in controlling the amounts of Al, Se and S that serve as inhibitors.

It will be understood from FIGS. 1, 2, and 3 that, with annealing conditions of the hot-rolled sheets of (a) 750° C.×1 min. and (c) 1050° C.×1 min., the value $B_8$ becomes less than 1.80 T in almost all kinds of steels, with rare appearance of steels having $B_8$ values of 1.85 T or more. When the annealing condition of the hot-rolled sheets is (b) 900° C.×1 min., on the other hand, the $B_8$ value was stabilized to 1.85 T or more in the composition region surrounded by the polygon ZYWVU of FIG. 2, i.e., the contents of Al, Se and S ([Al], [Se] and [S], each in wt %) substantially satisfy both of the following formulae (1) and (2) as well as both or either of the following formulae (3) and (4):

$$[Al\ (wt\ \%)]+(5/9)\{[Se\ (wt\ \%)]+2.47[S(wt\ \%)]\}\leqq 0.027 \quad (1)$$

$$[Se\ (wt\ \%)]+2.47[S\ (wt\ \%)]\leqq 0.025 \quad (2)$$

$$0.016\leqq[Al\ (wt\ \%)]+(5/9)\{[Se\ (wt\ \%)]+2.47\ [S\ (wt\ \%)]\} \quad (3)$$

$$0.010\leqq[Al\ (wt\ \%)] \quad (4)$$

The amounts of Al, Se and S defined by the four formulae define a range that is significantly and importantly less than the amounts used in the prior art. Although the amounts of Se and S have been reduced to values as small as those in this invention in the prior art without decreasing the amount of Al, nitriding on the way of processing was required. It was the thought of those working in the prior art that the content of Al should not be decreased, thereby preventing deterioration of the suppression ability of inhibitors. This is because, once the suppression ability of the inhibitors has been weakened, it might result in a failure to form a sufficient amount of secondary recrystallized grains or, even if secondary recrystallized grains were formed, most of the growth directions may be deviated from the {110}<001> direction. As we have indicated, nitriding on the way of processing, applied during decarbonization annealing, involves the serious problems that costly additional facilities are required, and that control of nitriding during finish annealing is difficult.

Contrary to the conventional knowledge and art, the results summarized in FIGS. 1, 2 and 3 show that, without applying any nitriding process in the way of processing, a grain-oriented silicon steel sheet can be produced that has good magnetic properties, through a process for heating the slab at as low a temperature as that used in producing common steels, and that this may surprisingly be done by appropriately controlling the amounts of Al, Se and S for optimizing the annealing conditions of the hot-rolled sheet.

Optimization of the annealing conditions is characterized by annealing at a significantly lower temperature than the annealing temperature for the usual grain-oriented silicon steel sheet within a short time. This is highly advantageous for reducing production cost. Amazing results have been obtained, namely, magnetic properties were significantly improved by reducing the content of Al to some degree, contrary to the conventional belief that reducing the content of Al would deteriorate magnetic properties.

The reason why the optimum annealing temperature for the hot-rolled sheets can surprisingly shift to a lower temperature and shorter time is not entirely understood, but it is believed that the lower the temperature for heating the slab, the finer become the microstructure in the hot-rolled sheet. Therefore, when the amount of Al, Se and S is concurrently reduced, and the ability as inhibitors is weak, grain growth on the surface will be so active that coarse grains tend to be appear near the surface. These coarse grains near the surface are believed to inhibit the growth of secondary recrystallized grains during subsequent formation of secondary recrystallized grains. For this reason, the annealing temperature for annealing the hot-rolled sheet can be controlled to a value that is lower than the conventional temperature, so as not to form coarse grains near the surface. When the slab heating temperature is low, annealing is not required for making the grain microstructure uniform. However, the annealing condition for the hot-rolled sheet prescribed in (a) described above (750° C.×1 min.) is not adequate since precipitation of fine inhibitor grains will be insufficient due to low heating temperature.

Based on the findings above, we have been alert to the combined effect of cold rolling temperature for the purpose of improving magnetic properties, and have closely studied the effect of rolling temperature on the magnetic properties of the product. The following chemical compositions (wt %) of the slabs were used for this work:

(A) Si: 3.15, C: 0.033, Al: 0.014, Se: 0.0110, S: 0.002
(B) Si: 3.08, C: 0.052, Al: 0.017, Se: 0.0070, S: 0.001
(C) Si: 3.19, C: 0.038, Al: 0.012, Se: 0.0015, S: 0.001
(D) Si: 2.90, C: 0.029, Al: 0.025, Se: 0.0080, S: 0.007
(E) Si: 3.26, C: 0.041, Al: 0.005, Se: 0.0060, S: 0.002

Figure 4:
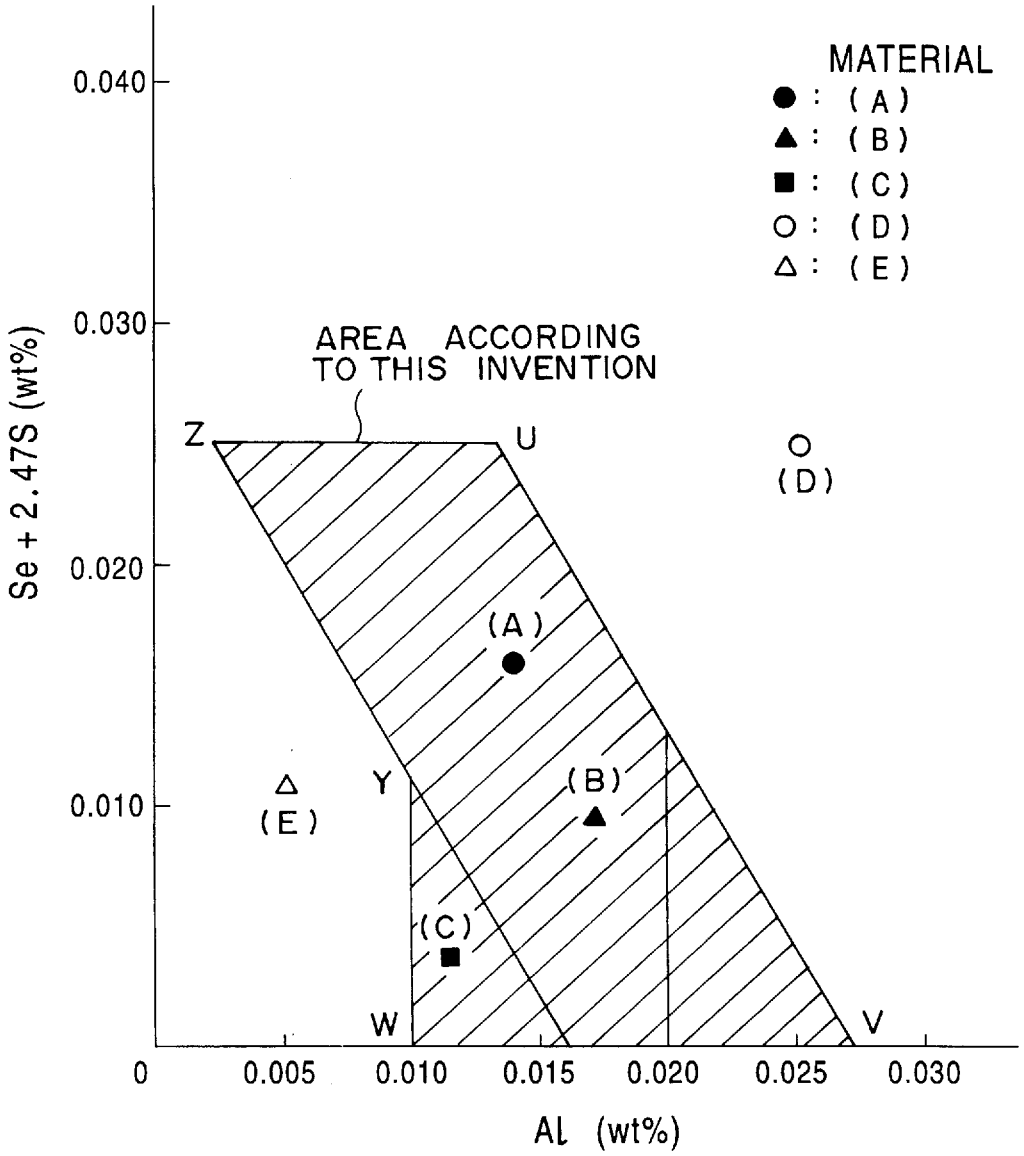
FIG. 4 is a graph showing contents of Al, Se and S in the slab of a steel used in an experiment.

These contents of Al, Se and S correspond to the position illustrated in FIG. 4 of the drawings when the content of Al is plotted along the horizontal axis and the contents of Se and S are plotted along the vertical axis. After heating these slabs to 1200° C., they were hot rolled to 2.3 mm followed by cold rolling to 0.35 mm after annealing the hot-rolled sheet at 900° C. for 1 minute. Cold rolling was carried out using a tandem mill while the rolling temperature was changed within a range where the tandem mill can be applied. Following decarbonization annealing, final finish annealing was applied after coating the sheet with an annealing separator. Magnetic flux density was measured on the samples thus obtained. The results are shown in FIG. 5.

Figure 5:
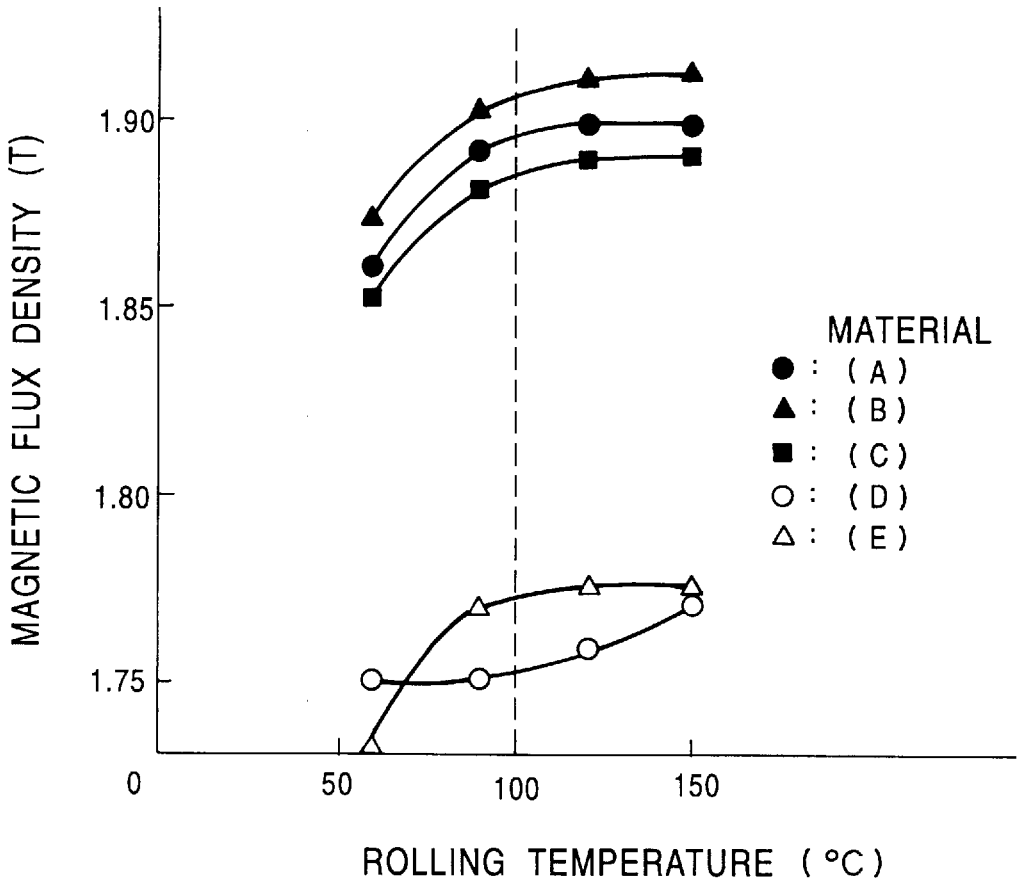
FIG. 5 is a graph showing a relationship between rolling temperature during cold rolling and magnetic properties.

When the warm rolling temperature was changed within a range where the tandem mill can be applied, it will be evident from FIG. 5 that, although remarkable improvement in the magnetic flux density is not observed in the material (D), the magnetic flux densities are significantly improved in the materials (A), (B), (C) and (E) by applying warm rolling at 100° C. or more.

The art of applying warm rolling for improving magnetic properties has been known, and aging of dynamic distortion during rolling as well as the aging of static distortion among paths have been thought to contribute to improvement of magnetic properties. From the point of view of enhancing aging by increasing rolling temperature, a Sendzimir mill is advantageous as compared to a tandem mill. From the point of view of reducing production cost, on the other hand, cold rolling may be more advantageously carried out by using a tandem mill rather than a Sendzimir mill in producing a common grain oriented silicon steel sheet. In the component system according to this invention in which the amounts of inhibitor components are relatively small, an amazing effect was found that magnetic properties are well improved by warm rolling at about 100° C. or more. This can be easily applied using a tandem mill. This is a landmark in the production of common grain-oriented silicon steel sheet.

It is not completely clear why magnetic properties can be improved by warm rolling at a relatively low temperature (about 100° C. that can easily be applied by a tandem mill) but the reasoning may be as follows: While a slab containing a usual amount of N, for example a content on the order of 0.0085 wt %, the content of Al in AlN with an atomic equivalence to N is 0.0164 wt % when the content of N is 0.0085 wt %. Although the number of Al atoms present seems to be considerably in excess compared with the number of N atoms in the usual grain-oriented silicon steel sheet, the number of N atoms is identical or more compared with the number of Al atoms in the composition according to this invention. Therefore, N atoms not bound to Al atoms are free atoms forming a solid solution, enhancing aging during warm rolling. As a result, magnetic properties in this invention seem to be improved even by warm rolling at a relatively low temperature due to the contributions of both carbon and nitrogen in the solid solution, contrary to the case in the usual grain-oriented silicon steel sheet where aging is due to carbon atoms only in the solid solution, in the warm rolling of material containing a high concentration of Al.

The warm rolling according to this invention, applied to the slab comprising the composition according to this invention, makes it possible to create improved magnetic properties at a temperature of about 100° C. or more, which is easily achievable even with a tandem mill.

The composition of the slab is important to this invention, for reasons that follow.

Si: about 2.5 to 4.5 wt %

Since Si is useful for increasing electrical resistance and reducing iron loss, about 2.5 wt % or more of Si is needed. A range of about 2.5 to 4.5 is preferable, however, because the rolling property deteriorates when the content is over about 4.5 wt %.

C: about 0.015 to 0.07 wt %

Since C is useful for improving the grain microstructure after hot rolling and allowing the growth of secondary recrystallized grains to proceed, a C content of at least about 0.015 wt % is required. However, a content of about 0.07 wt % is preferable since the problems are encountered that the rolling properties deteriorate when the C content is in excess—besides deteriorating the magnetic properties of the product because the excess carbon can hardly be eliminated by decarbonization annealing.

The contents of Al, Se and S ([Al], [Se] and [S], each in wt %) should substantially satisfy both of the following formulae (1) and (2) as well as satisfying both or either of the following formulae (3) and (4):

$$[\text{Al (wt \%)}]+(5/9)\{[\text{Se (wt \%)}]+2.47[\text{S(wt \%)}]\}\leqq 0.027 \quad (1)$$

$$[\text{Se (wt \%)}]+2.47[\text{S (wt \%)}]\leqq 0.025 \quad (2)$$

$$0.016\leqq[\text{Al (wt \%)}]+(5/9)\{[\text{Se (wt \%)}]+2.47[\text{S (wt \%)}]\} \quad (3)$$

$$0.010\leqq \text{Al (wt \%)} \quad (4)$$

These components serve as inhibitors in the form of AlN, MnSe and MnS. It is a useful technique for producing a grain-oriented silicon steel sheet to control precipitation of these inhibitors throughout the whole production process, making it essential to control the contents of Al, Se and S depending on the conditions of the process. The range of limitation was determined in this invention for obtaining satisfactory magnetic properties based on the test work described above.

Figure 7:
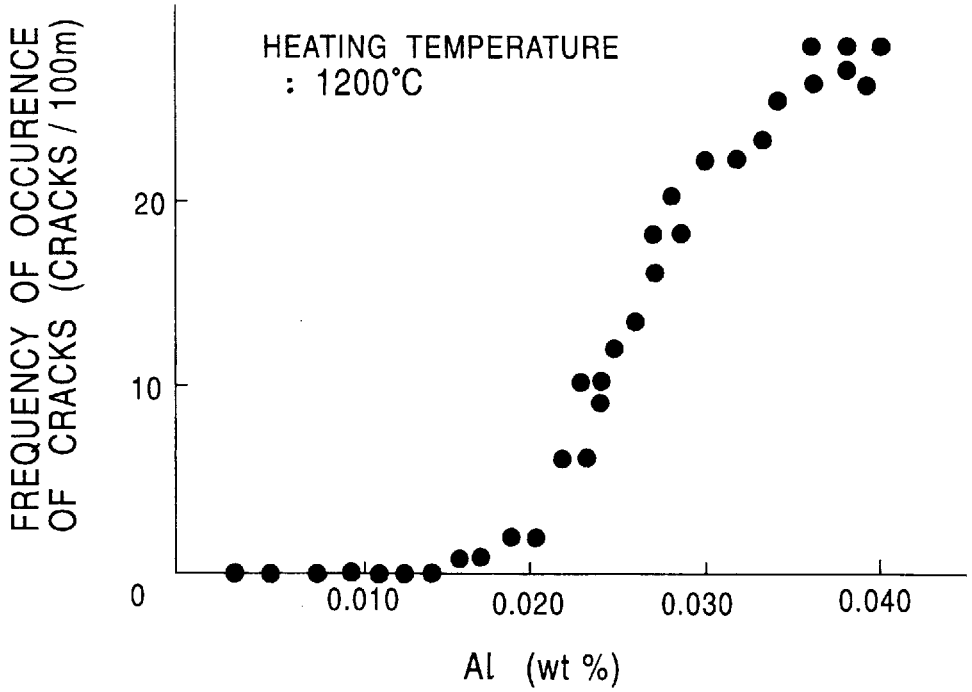
FIG. 7 is a graph showing the relationship between the content of Al in steel and frequency of occurrence of cracks during cold rolling.

We have also examined the relationship between the frequency of occurrence of cracks during cold rolling and the composition of the slab, making it clear that the frequency of occurrence of cracks has a close correlation with the content of Al in the steel. FIG. 7 is a graph indicating the frequency of occurrence of cracks after subjecting the sheet to cold rolling up to a thickness of 0.35 mm after heating a silicon steel slab with a thickness of 200 mm containing different quantities of Al to 1200° C., followed by annealing the hot rolling sheet at 1000° C. for 120 seconds after hot rolling up to a thickness of 2.2 mm. The contents of Si and C, which have been known to have a strong relationship with the frequency of occurrence of cracks, are adjusted to about 2.95 to 3.05 wt % and about 0.029 to 0.031 wt % for the contents of Si and C, respectively. It is now clear from FIG. 7 that the frequency of occurrence of cracks is low under the condition of about 0.020 wt % or less in the Al content.

Mn: about 0.04 to 2.0 wt %

Mn forms compounds MnSe and MnS by reacting with Se and S. They serve as inhibitors besides being useful for preventing the slab from being brittle during hot rolling. For these purposes, Mn should be present in an amount of about 0.04 wt % or more. However, since a content of more than about 2.0 wt % causes trouble in decarbonization, a range of about 0.04 to 2.0 wt % is preferable.

N: about 0.003 to 0.010 wt %

Since N is a component of AlN, a content of about 0.003 wt % or more is required. However, a content of more than about 0.010 wt % causes a swelling on the surface of products, so that a range of about 0.003 to 0.010 wt % is preferable.

Although there are no arbitrary limitations regarding other components, Cu, Cr, Sb, Nb and Sn can be also added as inhibitors in addition to AlN, MnSe and MnS.

Next, a production process according to this invention will be described.

First of all, the slab whose composition has been adjusted to a composition range as described above may be produced by continuous casting or rolling from an ingot.

Then, after heating the slab at about 1260° C. or below, a hot rolling process comprising pre-rolling and finish rolling is applied to form a hot rolling coil. The temperature for heating the slab should be about 1260° C. or below for the purposes of reducing the energy cost per unit weight of slabs nearly equal to that of common steels and preventing excessive creation of molten scale. Although a method for directly applying hot rolling after continuous casting without applying previous heating of the slab is possible, this method can be also advantageously applied according to this invention involving reduction of the heating temperature of the slab.

Annealing of the hot-rolled plate is applied to the hot-rolling coil to control precipitation of inhibitors. Growth control of grains can be effected by allowing the inhibitor to finely precipitate during temperature increase in annealing the hot rolling sheet. The temperature range for annealing the hot rolling sheet is limited to about 800° C. or more and about 1000° C. or less to obtain desirable magnetic properties. The reason why the temperature is limited to about 800° C. or more is that fine precipitation of inhibitors is insufficient at a temperature of less than about 800° C. while, at the temperature range more than about 1000° C., grain growth near the surface becomes so active that coarse grains near the surface is liable to appear, thereby preventing subsequent growth of secondary recrystallized grains. Therefore, the annealing temperature of the hot rolling sheet should be about 1000° C. or less so that any coarse grains near the surface do not appear.

After annealing the hot-rolled sheet, it is washed with an acid solution and is adjusted to a final thickness through one time of rolling or two times of rolling including intermediate annealing. The rolling mills used may be a tandem mill or a Sendzimir mill. When the cold rolling is applied with a tandem mill, the temperature for rolling is preferably about 100° C. or more. The upper limit of the rolling temperature is not especially limited, but a higher temperature improves magnetic properties provided the temperature is within the range where the tandem mill is applicable. Needless to say, applying warm rolling is also effective for improving magnetic properties when cold rolling is applied with a Sendzimir mill; the tandem mill is more advantageous for reducing production cost.

According to the method of this invention, the method can be easily applied with a tandem mill since a remarkable effect for improving magnetic properties can be obtained by warm rolling at a lower temperature.

EXAMPLES

Example 1

Figure 6:
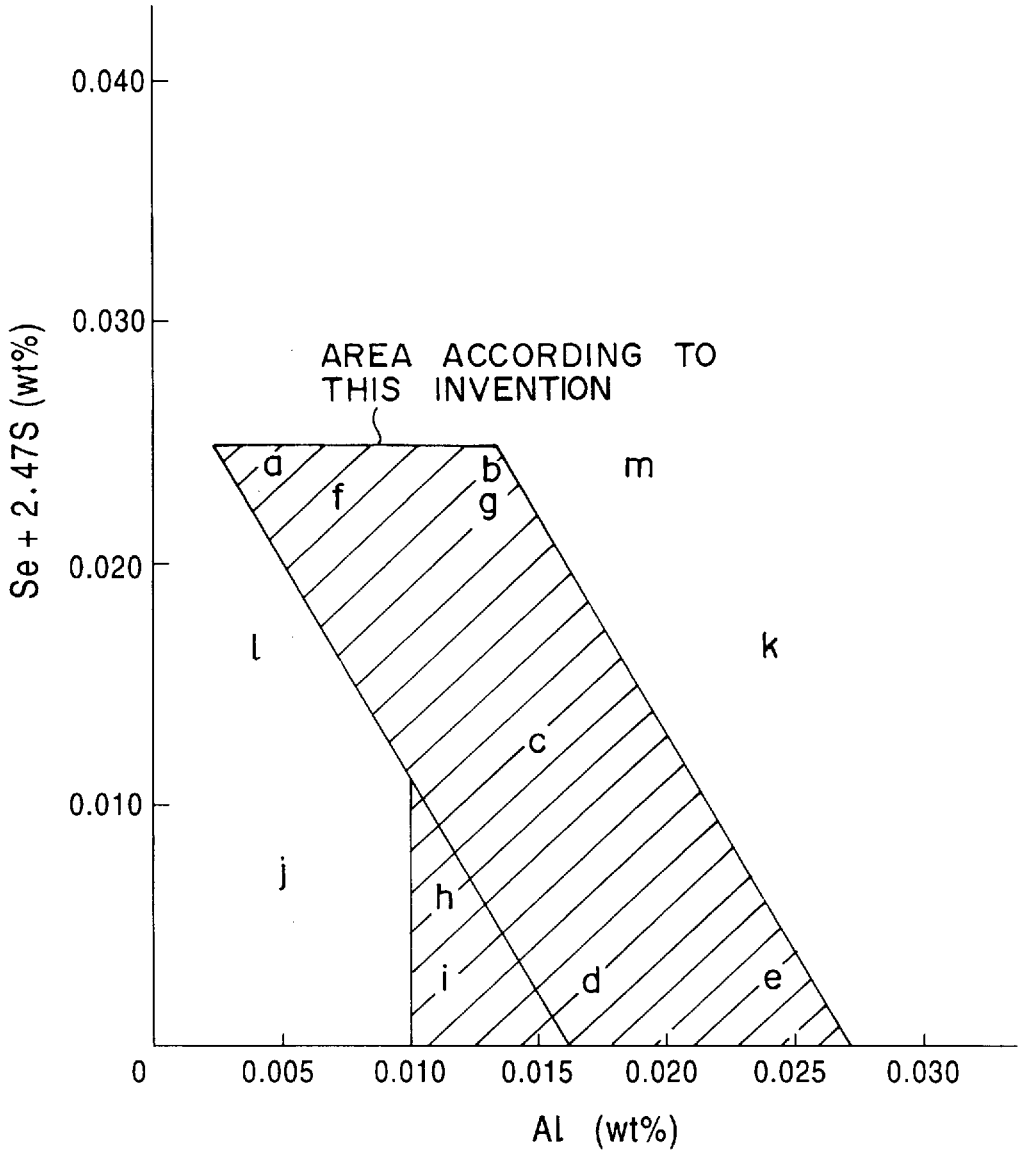
FIG. 6 is a graph showing contents of Al, Se and S in a slab of a steel used in an experiment.

After heating 13 kinds of slabs a to m at 1200° C., whose chemical compositions are listed in Table 1, the balance comprising Fe and inevitable impurities and having a thickness of 200 mm (the contents of Al, Se and S in each slab correspond to the area indicated in FIG. 6), the sheet was subjected to hot rolling up to a thickness of 2.2 mm. After annealing these hot-rolled sheets by holding them at 800° C., 850° C., 900° C., 950° C., 1000° C. and 1050° C. for 60 seconds, the sheets were washed with an acid solution, adjusted to a thickness of 0.34 mm at room temperature with a tandem mill, followed by applying decarbonization annealing at 840° C. for 120 seconds. After coating the decarbonized annealing sheet with an annealing separator, the sheet was subjected to final finish annealing. The resulting magnetic flux density and iron loss are listed in Table 2.

In the slabs a to i within the range of this invention, those produced by annealing at a temperature range of about 800° to 1000° C. showed good magnetic properties as a general purpose product with $B_8 \geqq 1.845$ T and $W_{17/50} \leqq 1.360$ W/kg.

TABLE 1

| | Chemical composition (wt % or wt ppm) | | | | | | | |
|---|---|---|---|---|---|---|---|---|
| Slab | Si (%) | C (ppm) | Al (%) | N (ppm) | Mn (%) | Se (%) | S (%) | Sb (%) |
| a | 3.23 | 485 | 0.005 | 85 | 0.07 | 0.022 | 0.001 | 0.012 |
| b | 3.21 | 501 | 0.013 | 81 | 0.07 | 0.020 | 0.002 | 0.013 |
| c | 3.19 | 311 | 0.015 | 78 | 0.07 | 0.010 | 0.001 | 0.010 |
| d | 3.22 | 502 | 0.017 | 90 | 0.07 | 0.001 | 0.001 | 0.015 |
| e | 3.20 | 408 | 0.024 | 84 | 0.07 | 0.001 | 0.001 | 0.012 |
| f | 3.20 | 402 | 0.007 | 83 | 0.08 | 0.001 | 0.009 | 0.013 |
| g | 3.19 | 295 | 0.013 | 86 | 0.07 | 0.001 | 0.009 | 0.012 |
| h | 3.35 | 475 | 0.011 | 75 | 0.06 | 0.002 | 0.002 | 0.020 |
| i | 3.09 | 446 | 0.011 | 86 | 0.08 | 0.001 | 0.001 | 0.021 |
| j | 3.19 | 506 | 0.005 | 88 | 0.07 | 0.002 | 0.002 | 0.013 |
| k | 3.18 | 298 | 0.024 | 81 | 0.08 | 0.015 | 0.001 | 0.014 |
| l | 3.21 | 412 | 0.004 | 85 | 0.07 | 0.010 | 0.003 | 0.011 |
| m | 3.21 | 398 | 0.019 | 85 | 0.08 | 0.015 | 0.004 | 0.012 |

TABLE 2

| | Annealing temperature of hot rolling sheet(°C.)* | | | | | | |
|---|---|---|---|---|---|---|---|
| Slab | 750 | 800 | 850 | 900 | 950 | 1000 | 1050 |
| a | 1.713 | 1.851 | 1.858 | 1.855 | 1.850 | 1.851 | 1.805 |
| | 1.691 | 1.338 | 1.319 | 1.333 | 1.345 | 1.346 | 1.579 |
| b | 1.612 | 1.849 | 1.855 | 1.863 | 1.870 | 1.858 | 1.714 |
| | 1.804 | 1.346 | 1.346 | 1.311 | 1.304 | 1.313 | 1.729 |
| c | 1.801 | 1.853 | 1.863 | 1.880 | 1.869 | 1.861 | 1.833 |
| | 1.574 | 1.340 | 1.315 | 1.290 | 1.301 | 1.309 | 1.420 |
| d | 1.785 | 1.855 | 1.860 | 1.873 | 1.878 | 1.875 | 1.831 |
| | 1.696 | 1.318 | 1.288 | 1.279 | 1.270 | 1.272 | 1.411 |
| e | 1.647 | 1.850 | 1.857 | 1.860 | 1.865 | 1.865 | 1.822 |
| | 1.856 | 1.320 | 1.305 | 1.295 | 1.280 | 1.286 | 1.398 |
| f | 1.699 | 1.853 | 1.852 | 1.856 | 1.858 | 1.850 | 1.777 |
| | 1.705 | 1.359 | 1.349 | 1.335 | 1.335 | 1.351 | 1.644 |
| g | 1.669 | 1.851 | 1.858 | 1.860 | 1.853 | 1.854 | 1.715 |
| | 1.829 | 1.346 | 1.331 | 1.327 | 1.338 | 1.340 | 1.771 |
| h | 1.650 | 1.850 | 1.857 | 1.857 | 1.863 | 1.860 | 1.725 |
| | 1.804 | 1.340 | 1.325 | 1.326 | 1.295 | 1.302 | 1.621 |
| i | 1.644 | 1.852 | 1.855 | 1.856 | 1.863 | 1.859 | 1.775 |
| | 1.839 | 1.344 | 1.327 | 1.319 | 1.288 | 1.310 | 1.608 |
| j | 1.724 | 1.751 | 1.733 | 1.775 | 1.703 | 1.615 | 1.558 |
| | 1.845 | 1.807 | 1.800 | 1.796 | 1.815 | 1.880 | 1.921 |
| k | 1.564 | 1.581 | 1.601 | 1.695 | 1.714 | 1.705 | 1.587 |
| | 1.955 | 1.899 | 1.881 | 1.850 | 1.841 | 1.847 | 1.902 |
| l | 1.635 | 1.740 | 1.748 | 1.730 | 1.695 | 1.584 | 1.584 |
| | 1.884 | 1.801 | 1.799 | 1.830 | 1.859 | 1.893 | 1.898 |
| m | 1.571 | 1.593 | 1.660 | 1.693 | 1.695 | 1.679 | 1.685 |
| | 1.890 | 1.877 | 1.841 | 1.792 | 1.805 | 1.818 | 1.826 |

After cold rolling 0.34 mm thickness Top row $B_8$(T) Bottom row $W_{17/50}$W/kg)

*The underlined numbers are examples according to this invention; the others are comparative examples outside the scope of this invention.

Example 2

Under conditions by which good magnetic properties were obtained (the composition and annealing temperature for the hot rolling sheet belonging to the range according to this invention in Table 2), cold rolling was applied using a tandem mill at a temperature of 120° C. The slab symbols correspond those in Table 1 and FIG. 6 with a thickness of 200 mm, a slab heating temperature of 1200° C. and the thickness of the hot rolling sheet 2.2 mm. After annealing the hot-rolled sheet, the sheet was washed with an acid solution and the thickness of the sheet was adjusted to 0.34 mm with a tandem mill. After subjecting the sheet to decarbonization annealing by holding it at 840° C. for 120 seconds, an annealing separator was coated on the sheet followed by final finish annealing. The magnetic flux density and iron loss of the product are listed in Table 3.

By comparing Table 3 with Table 2, it is evident that magnetic properties were improved by 0.02 to 0.04 T in $B_8$ and 0.01 to 0.05 W/kg in $W_{17/50}$.

TABLE 3

| | Annealing temperature of hot rolling sheet(°C.) | | | | |
|---|---|---|---|---|---|
| Slab | 800 | 850 | 900 | 950 | 1000 |
| a | 1.884 | 1.896 | 1.891 | 1.885 | 1.881 |
| | 1.300 | 1.291 | 1.298 | 1.316 | 1.309 |
| b | 1.882 | 1.896 | 1.902 | 1.906 | 1.898 |
| | 1.309 | 1.305 | 1.276 | 1.271 | 1.287 |
| c | 1.891 | 1.900 | 1.921 | 1.905 | 1.892 |
| | 1.301 | 1.277 | 1.261 | 1.275 | 1.280 |
| d | 1.888 | 1.894 | 1.914 | 1.913 | 1.905 |
| | 1.266 | 1.251 | 1.236 | 1.239 | 1.245 |
| e | 1.889 | 1.893 | 1.899 | 1.901 | 1.905 |
| | 1.279 | 1.264 | 1.253 | 1.247 | 1.243 |
| f | 1.879 | 1.881 | 1.895 | 1.891 | 1.887 |
| | 1.324 | 1.315 | 1.297 | 1.299 | 1.314 |
| g | 1.884 | 1.896 | 1.890 | 1.889 | 1.883 |
| | 1.308 | 1.291 | 1.289 | 1.301 | 1.306 |
| h | 1.881 | 1.895 | 1.892 | 1.895 | 1.888 |
| | 1.309 | 1.290 | 1.285 | 1.281 | 1.293 |
| i | 1.875 | 1.878 | 1.887 | 1.893 | 1.885 |
| | 1.291 | 1.289 | 1.279 | 1.276 | 1.290 |

After cold rolling 0.34 mm thickness Top row $B_8$(T) Bottom row $W_{17/50}$(W/kg)
Rolling temperature 120° C.
(all Table 3 results are according to this invention)

Example 3

After heating 13 kinds of slabs (thickness of the slab 200 mm) to 1200° C., the sheet was subjected to hot rolling up to a thickness of 1.6 mm. After annealing these hot rolling sheets by holding them at each temperature of 750° C., 800° C., 850° C., 900° C., 950° C., 1000° C. and 1050° C. by holding for 60 seconds, the sheets were washed with an acid solution, adjusted to a thickness of 0.22 mm at room temperature with a tandem mill, followed by applying decarbonization annealing by keeping the sheet at 840° C. for 120 seconds. After coating the decarbonized annealing sheet with an annealing separator, the sheet was subjected to final finish annealing. The magnetic flux density and iron loss of the products are listed in Table 4.

In the slabs a to i within the range of this invention, those produced by annealing at a temperature range of about 800° to 1000° C. showed good magnetic properties as a general purpose product with $B_8 \geqq 1.845$ T and $W_{17/50} \leqq 1.010$ W/kg.

TABLE 4

| Slab | Annealing temperature of hot rolling sheet(°C.) 750 | 800 | 850 | 900 | 950 | 1000 | 1050 |
|---|---|---|---|---|---|---|---|
| 1.690[<a]Tc;;4 | 1.855 | 1.857 | 1.860 | 1.852 | 1.850 | 1.784 | |
| | 1.393 | 1.001 | 0.984 | 0.983 | 0.995 | 0.995 | 1.254 |
| b | 1.635 | 1.852 | 1.856 | 1.861 | 1.868 | 1.854 | 1.681 |
| | 1.471 | 0.999 | 0.991 | 0.980 | 0.970 | 0.983 | 1.394 |
| c | 1.811 | 1.853 | 1.866 | 1.878 | 1.871 | 1.856 | 1.807 |
| | 1.229 | 1.004 | 0.973 | 0.948 | 0.960 | 0.972 | 1.231 |
| d | 1.791 | 1.857 | 1.851 | 1.875 | 1.880 | 1.864 | 1.820 |
| | 1.346 | 0.971 | 0.973 | 0.943 | 0.936 | 0.945 | 1.068 |
| e | 1.635 | 1.848 | 1.850 | 1.857 | 1.857 | 1.851 | 1.809 |
| | 1.522 | 0.981 | 0.979 | 0.972 | 0.974 | 0.997 | 1.088 |
| f | 1.711 | 1.855 | 1.860 | 1.866 | 1.861 | 1.857 | 1.784 |
| | 1.359 | 1.007 | 1.004 | 0.995 | 0.996 | 1.000 | 1.289 |
| g | 1.673 | 1.854 | 1.858 | 1.858 | 1.857 | 1.850 | 1.701 |
| | 1.505 | 0.996 | 0.983 | 0.981 | 0.985 | 0.990 | 1.495 |
| h | 1.655 | 1.853 | 1.856 | 1.860 | 1.863 | 1.859 | 1.760 |
| | 1.496 | 0.992 | 0.985 | 0.982 | 0.979 | 0.991 | 1.308 |
| i | 1.661 | 1.852 | 1.853 | 1.859 | 1.865 | 1.862 | 1.770 |
| | 1.511 | 1.002 | 0.995 | 0.984 | 0.976 | 0.980 | 1.298 |
| j | 1.718 | 1.740 | 1.745 | 1.785 | 1.721 | 1.634 | 1.603 |
| | 1.503 | 1.481 | 1.478 | 1.446 | 1.496 | 1.549 | 1.587 |
| k | 1.557 | 1.571 | 1.615 | 1.703 | 1.725 | 1.697 | 1.561 |
| | 1.617 | 1.570 | 1.533 | 1.499 | 1.481 | 1.510 | 1.622 |
| l | 1.626 | 1.711 | 1.754 | 1.729 | 1.702 | 1.631 | 1.570 |
| | 1.551 | 1.489 | 1.463 | 1.476 | 1.495 | 1.550 | 1.608 |
| m | 1.525 | 1.558 | 1.634 | 1.688 | 1.654 | 1.609 | 1.548 |
| | 1.621 | 1.607 | 1.565 | 1.517 | 1.531 | 1.577 | 1.619 |

After cold rolling 0.22 mm thickness Top row $B_8$(T) Bottom row $W_{17/50}$(W/kg)
The underlined numbers are examples according to this invention; the others are comparative examples.

Example 4

Under good magnetic conditions of example 3 (the composition and annealing temperature for the hot rolling sheet belonging to the range according to this invention in Table 4), cold rolling was applied using a tandem mill at a temperature of 120° C. The slab symbols correspond those in Table 1 and FIG. 6 with a thickness of 200 mm, slab heating temperature of 1200° C and thickness of the hot rolling sheet of 1.6 mm. After annealing the hot rolling sheet, the sheet was washed with an acid solution and the thickness of the sheet was adjusted to 0.22 mm with a tandem mill. After subjecting the sheet to decarbonization annealing by holding it at 840° C. for 120 seconds, an annealing separator was coated on the sheet followed by final finish annealing. The magnetic flux density and iron loss of the product are listed in Table 5.

By comparing Table 5 with Table 4, it is evident that magnetic properties improved by 0.02 to 0.04 T in $B_8$ and 0.01 to 0.04 W/kg in $W_{17/50}$.

TABLE 5

| Slab | Annealing temperature of hot rolling sheet(°C.) 750 | 800 | 850 | 900 | 950 |
|---|---|---|---|---|---|
| a | 1.885 | 1.893 | 1.897 | 1.887 | 1.882 |
| | 0.964 | 0.951 | 0.946 | 0.959 | 0.965 |
| b | 1.880 | 1.891 | 1.894 | 1.905 | 1.890 |
| | 0.967 | 0.956 | 0.948 | 0.931 | 0.950 |
| c | 1.889 | 1.903 | 1.918 | 1.915 | 1.895 |
| | 0.970 | 0.936 | 0.911 | 0.916 | 0.961 |
| d | 1.895 | 1.895 | 1.916 | 1.920 | 1.900 |
| | 0.936 | 0.931 | 0.902 | 0.895 | 0.922 |
| e | 1.885 | 1.888 | 1.896 | 1.898 | 1.887 |
| | 0.945 | 0.941 | 0.931 | 0.929 | 0.933 |
| f | 1.893 | 1.899 | 1.902 | 1.900 | 1.895 |

TABLE 5-continued

| Slab | Annealing temperature of hot rolling sheet(°C.) 750 | 800 | 850 | 900 | 950 |
|---|---|---|---|---|---|
| | 0.969 | 0.960 | 0.953 | 0.959 | 0.965 |
| g | 1.895 | 1.903 | 1.905 | 1.901 | 1.889 |
| | 0.960 | 0.949 | 0.944 | 0.946 | 0.969 |
| h | 1.889 | 1.893 | 1.904 | 1.900 | 1.886 |
| | 0.961 | 0.958 | 0.950 | 0.952 | 0.970 |
| i | 1.891 | 1.895 | 1.906 | 1.901 | 1.895 |
| | 0.960 | 0.957 | 0.948 | 0.955 | 0.952 |

After cold rolling 0.34 mm thickness Top row $B_8$(T) Bottom row $W_{17/50}$(W/kg)
Rolling temperature 120° C.
Magnetic properties of the product sheets when a tandem mill was applied at 120° C. (all according to this invention)

According to this invention, we continuously produced grain-oriented silicon steel sheets having excellent magnetic properties, notwithstanding the numerous problems that existed in the art.

What is claimed is:

1. In a method for producing a grain-oriented silicon steel sheet wherein a silicon steel slab is subjected to heating and then hot rolling, and wherein the resulting hot-rolled steel sheet is annealed, followed by single or multiple cold rolling to adjust the annealed sheet to final thickness, and said sheet is treated by decarbonization annealing, coating the sheet with an annealing separator followed by finish annealing, the novel steps wherein the contents of Al, Se and S ([Al], [Se] and [S], each in wt %) substantially satisfy both of the following formulae (1) and (2) as well as both or either of the following formulae (3) and (4):

$$[\text{Al (wt \%)}]+(5/9)\{[\text{Se (wt \%)}]+2.47[\text{S(wt \%)}]\}\leqq 0.027 \quad (1)$$

$$[\text{Se (wt \%)}]+2.47[\text{S (wt \%)}]\leqq 0.025 \quad (2)$$

$$0.016\leqq[\text{Al (wt \%)}]+(5/9)\{[\text{Se (wt \%)}]+2.47\,[\text{S (wt \%)}]\} \quad (3)$$

$$0.010\leqq[\text{Al (wt \%)}] \quad (4)$$

wherein said step of heating said slab is conducted at about 1260° C. or less, and wherein said step of annealing said hot-rolled sheet prior to cold rolling is conducted at about 800° C.–1000° C.

2. The method according to claim 1, wherein the content of Al ([Al] in wt %) substantially satisfies the following formula (5):

$$[\text{Al (wt \%)}]\leqq 0.020 \quad (5).$$

3. The method according to claim 1, wherein said slab comprises about 0.015 to 0.070 wt % of C and about 2.5 to 4.5 wt % of Si.

4. The method according to claim 2, wherein said slab comprises about 0.015 to 0.070 wt % of C and about 2.5 to 4.5 wt % of Si.

5. The method according to claim 1, wherein said cold rolling step is carried out at a temperature of about 100° C. or more.

6. The method according to claim 2, wherein said cold rolling step is carried out at a temperature of about 100° C. or more.

7. The method defined in claim 1, wherein said cold rolling step is carried out in a tandem mill at a temperature of about 100° C. or more.

8. The method defined in claim 2, wherein said cold rolling step is carried out in a tandem mill at a temperature of about 100° C. or more.

* * * * *

UNITED STATES PATENT AND TRADEMARK OFFICE

CERTIFICATE OF CORRECTION

PATENT NO. : 5,855,694

DATED : January 5, 1999

INVENTOR(S) : Toge, et al

It is certified that error appears in the above-identified patent and that said Letters Patent is hereby corrected as shown below:

In Column 11, at Table 4, at the subheading "Slab", at line 1, please change "1.690 [<a] Tc;;4" to --a--;

at the subheading "750", at line 1, please change "1.855" to --1.690;

at the subheading "800", at line 1, please change "1.857" to --1.855--;

at the subheading "850", line 1, please change "1.860" to --1.857--;

at the subheading "900", at line 1, please change "1.852" to --1.860--;

at the subheading "950", at line 1, please change "1.850" to --1.852--;

at the subheading "1000", at line please change "1.784" to --1.850--; and

UNITED STATES PATENT AND TRADEMARK OFFICE

CERTIFICATE OF CORRECTION

PATENT NO. : 5,855,694

DATED : January 5,1999

INVENTOR(S) : Toge, et al.

It is certified that error appears in the above-identified patent and that said Letters Patent is hereby corrected as shown below:

at the subheading "1050", at line 1, please insert --1.784--.

Signed and Sealed this

Twenty-fifth Day of May, 1999

*Attest:*

Q. TODD DICKINSON

*Attesting Officer*

*Acting Commissioner of Patents and Trademarks*